US010316583B2

(12) United States Patent
Birkkjaer

(10) Patent No.: US 10,316,583 B2
(45) Date of Patent: Jun. 11, 2019

(54) SCREENING ARRANGEMENT

(71) Applicant: VKR Holding A/S, Hørsholm (DK)

(72) Inventor: Martin Birkkjaer, Tjaereborg (DK)

(73) Assignee: VKR Holding A/S (DK)

( * ) Notice: Subject to any disclaimer, the term of this patent is extended or adjusted under 35 U.S.C. 154(b) by 199 days.

(21) Appl. No.: 15/428,355

(22) Filed: Feb. 9, 2017

(65) Prior Publication Data

US 2017/0226797 A1 Aug. 10, 2017

(30) Foreign Application Priority Data

Feb. 10, 2016 (EP) ..... 16155082

(51) Int. Cl.
*E06B 9/52* (2006.01)
*A47H 1/13* (2006.01)

(52) U.S. Cl.
CPC ..... *E06B 9/52* (2013.01); *A47H 1/13* (2013.01); *E06B 2009/527* (2013.01)

(58) Field of Classification Search
CPC ..... E06B 2009/527; E06B 9/52; A47H 1/13
USPC ..... 160/903, 368.1, 23.1, 34, 181, 902, 160/323.1; 248/266, 267, 268
See application file for complete search history.

(56) References Cited

U.S. PATENT DOCUMENTS 2,039,538 A * 5/1936 Kirsch ..... E06B 9/323 160/902
2,912,209 A * 11/1959 Turner ..... E06B 9/50 248/266
3,304,034 A * 2/1967 Jones ..... A47K 10/38 206/408

(Continued)

FOREIGN PATENT DOCUMENTS

CN 203846971 9/2014
CN 205012898 2/2016

(Continued)

OTHER PUBLICATIONS

Hefa, English Translation of "DE 29915771" Obtained from <https://worldwide.espacenet.com/?locale=en_EP>. (Year: 1999).*

(Continued)

*Primary Examiner* — Katherine W Mitchell
*Assistant Examiner* — Johnnie A. Shablack
(74) *Attorney, Agent, or Firm* — Merek, Blackmon & Voorhees, LLC

(57) ABSTRACT

In the screening arrangement, a screening device is provided with end pieces adapted to be mounted on mounting brackets (6). Locking members are provided on the end pieces and the mounting brackets for providing engagement, between these components. The locking members include mutually cooperating female and male locking members, of which the mounting brackets (6) are provided with two female locking members (12, 14) to cooperate successively with one male locking member of the respective end piece, so that it is possible to provide engagement between each end piece and the respective mounting bracket in at least two positions including a first, temporary position and a second, terminal position on the mounting bracket, when the end pieces are moved with the screening device in the third direction from the point distant from the pane to the point proximate to the pane.

25 Claims, 10 Drawing Sheets

(56) References Cited

U.S. PATENT DOCUMENTS 4,225,814 A * 9/1980 Gantz ..... A47L 5/24 320/115
4,538,785 A * 9/1985 Damsgaard ..... E06B 9/50 248/268
D300,214 S * 3/1989 Adams ..... D13/108
5,083,601 A * 1/1992 Tedeschi ..... E06B 9/50 160/323.1
5,450,891 A * 9/1995 Benthin ..... E06B 9/50 160/323.1
5,997,318 A * 12/1999 Chou ..... H01R 13/5213 439/136
6,049,725 A * 4/2000 Emmert ..... H04B 1/3883 455/573
6,273,173 B1 * 8/2001 Lassen ..... E06B 9/42 160/84.06
6,283,427 B1 * 9/2001 Møller et al. ..... E06B 9/323 160/903
6,550,733 B1 * 4/2003 Lassen ..... E06B 9/50 160/323.1
6,929,049 B2 * 8/2005 Nicolosi ..... E06B 9/264 160/107
7,267,311 B2 * 9/2007 Jung ..... E06B 9/50 160/903
7,677,294 B2 * 3/2010 Bohlen ..... E06B 9/50 160/323.1
8,051,891 B2 * 11/2011 Birkkjær ..... E06B 9/323 160/323.1
8,122,932 B2 * 2/2012 Cannaverde ..... E06B 9/174 160/120
8,123,182 B2 * 2/2012 Sonntag ..... F16M 11/10 248/220.22
8,256,491 B2 * 9/2012 Birkkjær ..... E06B 9/323 160/323.1
8,714,500 B2 * 5/2014 Ng ..... E06B 9/50 248/222.11
8,800,634 B2 * 8/2014 Gramsch ..... E06B 9/50 160/323.1
9,247,840 B2 * 2/2016 Diamond ..... E06B 9/42
9,988,839 B2 * 6/2018 Geiger ..... A47H 1/13
10,053,304 B2 * 8/2018 Reinthaler ..... B65G 54/02
2002/0195991 A1 * 12/2002 Son ..... G06F 1/1632 320/111
2003/0051830 A1 * 3/2003 Garcia Garcia ..... E06B 9/42 160/323.1
2003/0201753 A1 * 10/2003 Kinoshita ..... H02J 7/0044 320/114
2006/0089178 A1 * 4/2006 Sakata ..... H02J 7/0044 455/573
2007/0041213 A1 * 2/2007 Short ..... F16M 11/105 362/561
2009/0127369 A1 * 5/2009 Mullet ..... E06B 9/56 242/379
2013/0153162 A1 * 6/2013 Blair ..... E06B 9/68 160/310
2017/0226797 A1 * 8/2017 Birkkjaer ..... E06B 9/52

FOREIGN PATENT DOCUMENTS

| | | |
|---|---|---|
| DE | 29915771 | 12/1999 |
| EP | 0032884 | 7/1981 |
| EP | 2716857 | 4/2014 |
| EP | 2733299 | 5/2014 |
| EP | 2474702 | 9/2014 |
| WO | WO99/07974 | 2/1999 |
| WO | WO00/47858 | 8/2000 |
| WO | WO2005/008013 | 1/2005 |
| WO | WO2006/048014 | 5/2006 |
| WO | WO2007/110072 | 10/2007 |
| WO | WO2008/131757 | 11/2008 |

OTHER PUBLICATIONS

European Search Report dated Aug. 1, 2016 issued in EP16155082.7, eight (8) pages.

English translation of Chinese Search Report dated May 17, 2018 issued in Chinese Patent Application No. 201710071134.6, two (2) pages.

* cited by examiner

SCREENING ARRANGEMENT

FIELD OF THE INVENTION

The present invention relates to a screening arrangement comprising a screening device with a set of end pieces and a set of mounting brackets, with locking means including mutually cooperating female and male locking means. The invention furthermore relates to a window having a frame and a set of mounting brackets mounted to the frame, and a method of installing such a screening arrangement in a window.

BACKGROUND OF THE INVENTION

As such screening arrangements are provided in a supply condition, and the person performing the installation is most often not a craftsman, the mounting of the screening arrangement in the window frame must be able to be carried out without too many difficulties and with a low risk of erroneous installation. The window frame may be either a stationary frame or sash, or an openable sash.

Such support assemblies are described in Applicant's published international applications and counterpart European patents Nos WO 99/07974 A1 (EP 1003953 B1) and WO 00/47858 A1 (EP 1151176 B1).

In support assemblies of the kind mentioned in the above, relatively safe temporary retention of the screening arrangement by means of the support assembly is vital to facilitate the installation. For instance, in WO 00/47858 A1, a squeezing, clamping or springy action is provided to ensure temporary retention by obtaining a close contact between the coupling member and the mounting bracket.

However, at the same time there is a profound need to make sure that the mounting brackets are fastened securely to the window frame members. In practice, the mounting brackets need fastening means typically in the form of pins or dowels on the backside of the mounting bracket introduced into corresponding apertures in the side pieces of the window frame to provide a lasting stationary fastening of the mounting bracket relative to the frame. Separate external fastening means such as screws may provide additional securing of the mounting bracket relative to the frame in order to attain the stable permanent fixing aimed at.

The application of screws or other frame penetrating fastening means are usually not desired. Hence, a number of further documents suggest solutions in which secondary fastening is provided, including U.S. Pat. No. 2,039,538, EP2733299, US 2013/153162 A1 and EP 32 884.

Eventually, Applicant's published international applications and counterpart European patents or patent applications Nos WO 2005/008013 A1 (EP 1857630); WO 2006/048014 A1 (EP1807598B1); and WO 2007/110072 A1 (EP2002079). Even though these solutions have proven to function well over the years, there is an ever-increasing need for even more flexible and facilitated installation.

SUMMARY OF THE INVENTION

With this background it is the object of the invention to provide facilitated installation of a screening arrangement, in which it is nevertheless possible to provide a stable engagement without the use of additional fastening means.

In a first aspect, this and further objects are met by a screening arrangement of the kind mentioned in the introduction, which is furthermore characterised in that said locking means comprise at least two female locking means to cooperate successively with one male locking means, so that it is possible to provide engagement between each end piece and the respective mounting bracket in at least two positions including a first, temporary position and a second, terminal position on the mounting bracket, when the end pieces are moved with the screening device in the point distant from the pane to the point proximate to the pane.

In this manner, the desired flexible installation procedure is achieved. In the first, temporary position, the screening device may be left temporarily in position, before reaching the final and mounted condition in the second, terminal position, all without the use of tools or the like. It is conceivable to have more than two positions between the first, temporary position and the terminal position.

In a presently preferred embodiment the at least two female locking means are provided substantially below the upper line defined by the top ledge parallel to the length dimension of the mounting bracket, in the third direction in the mounted condition of the mounting bracket. In this manner, the mounting of the end pieces on the mounting brackets is carried out securely in that the top ledge defines the top of the mounting bracket, without parts or elements protruding beyond the top.

In a further preferred embodiment, the at least two female locking means comprise a first recess in the top ledge of the mounting bracket closer to the point distant from the pane as seen in the third direction in the mounted condition of the mounting bracket to provide the first, temporary position. This provides for easy and logical mounting, as the user pushing the screening device in the third direction first experiences a temporary halting of the movement when the male locking means of the end piece engages with the first recess. Subsequently, the movement is continued in the same direction until the screening device is closer to the pane and the male locking means engages with the second female locking means to attain the terminal position.

In a development of the above further preferred embodiment, the first recess is provided with an over-dimension in the length dimension of the mounting bracket relative to corresponding dimension of the male locking means. In this way, the user experiences a stable but movable engagement of the screening device with the mounting brackets, thus signalling that the temporary position has been reached.

In order to facilitate the mounting procedure, the first recess may be provided with a first inclined portion, a second bottom portion and a third inclined portion. This makes sure that the male locking means of the end pieces of the screening device ride smoothly on the mounting brackets. The third inclined portion may have an inclination of 20 to 60 degrees with the length dimension of the mounting bracket.

In one preferred embodiment, the at least two female locking means comprise a second recess in the top ledge of the mounting bracket closer to the point proximate to the pane as seen in the third direction in the mounted condition of the mounting brackets to provide the second, terminal position. By forming the second female locking means as a recess, a very stable and reliable locking of the screening device relative to the mounting brackets is obtained in the mounted condition thereof.

Preferably, the second recess is provided with a first inclined portion, a second bottom portion and a third inclined portion for easy and smooth mounting. The first inclined portion may have an inclination of 45 to 80 degrees with the length dimension of the mounting bracket.

In an embodiment, which is particularly advantageous with respect to the mounting of the screening device, the third inclined portion of the first recess has a smaller inclination than the first inclined portion of the second recess. In this manner, release force in bringing the screening device from the terminal position to the temporary position is larger than mounting force from the temporary to the terminal position.

A safe and reliable mounting of the screening device is obtained in an embodiment, in which the third inclined portion of the second recess is substantially perpendicular to the upper line of the mounting bracket. The user mounting the screening device will experience a full stop and thus receive confirmation that the terminal position has been reached.

It is preferred to have a sufficiently large support surface for the top flange of the end piece on the mounting bracket, and hence the top ledge of the mounting bracket may be composed by a front portion, a bridge portion separating the first recess from the second recess, and a back portion, each of these portions being positioned substantially on the upper line, preferably in parallel with the third direction in the mounted condition of the mounting bracket.

In an embodiment which has a harmonic appearance and which furthermore provides for cooperation with screening devices having locking means at the bottom part of the end pieces, at least two female locking means comprise a third recess opposite the first recess and a fourth recess opposite the second recess substantially above a lower line parallel to the length dimension of the mounting bracket.

In an alternative embodiment, the at least two female locking means comprise a shoulder portion closer to the point proximate to the pane as seen in the third direction in the mounted condition of the mounting bracket to provide the second, terminal position. In a further development of this alternative embodiment, the at least two female locking means comprise an opposing recess opposite the first recess and an opposing shoulder portion opposite the shoulder portion substantially above a lower line parallel to the length dimension of the mounting bracket.

Preferably, in this embodiment, the first recess is separated from the shoulder portion by a bridge portion positioned on the upper line, the bridge portion being substantially parallel to the third direction in the mounted condition of the mounting bracket. Furthermore, in an advantageous further development, the top ledge is composed by a front portion and the bridge portion, each of these portions being positioned substantially on the upper line, preferably in parallel with the third direction in the mounted condition of the mounting bracket.

In an embodiment, which is particularly advantageous as regards easy mounting, the mounting bracket is provided with a front portion with a front edge and two rounded front corners and a back portion with a back edge.

A multi-purpose mounting bracket is obtained in an embodiment in which the first recess is provided with a flange in the area of the first recess, substantially extending in parallel with a plane defined by the length and height dimension of the mounting bracket, said flange having a reduced thickness relative to the thickness of the mounting bracket. The mounting bracket may thus be used for hanging accessory components on.

The mutually cooperating locking means preferably comprise snap locking means which are well-known to provide safe engagement.

In a preferred development of this embodiment, the snap locking means comprise resilient engagement means of the male locking means of the respective end piece to provide a spring bias in the first direction, the second direction or the third direction or a combination of the first, second and/or third directions.

The snap locking means are preferably formed such that an indication of the snap locking is provided when the respective end piece is in the second, terminal position.

In a second aspect, a window is provided. In a third aspect, a method of installing a screening arrangement is provided.

The advantages of the first aspect of the invention and further developed embodiments are also applicable to the second and third aspects of the invention as have been described in the above and reference is made thereto.

Further details are described, and further advantages stated, in the description of particular embodiments of the invention.

BRIEF DESCRIPTION OF THE DRAWINGS

In the following the invention will be described in further detail by means of examples of embodiments with reference to the schematic drawings, in which.

DESCRIPTION OF DETAILED EMBODIMENTS OF THE INVENTION

Figure 1:
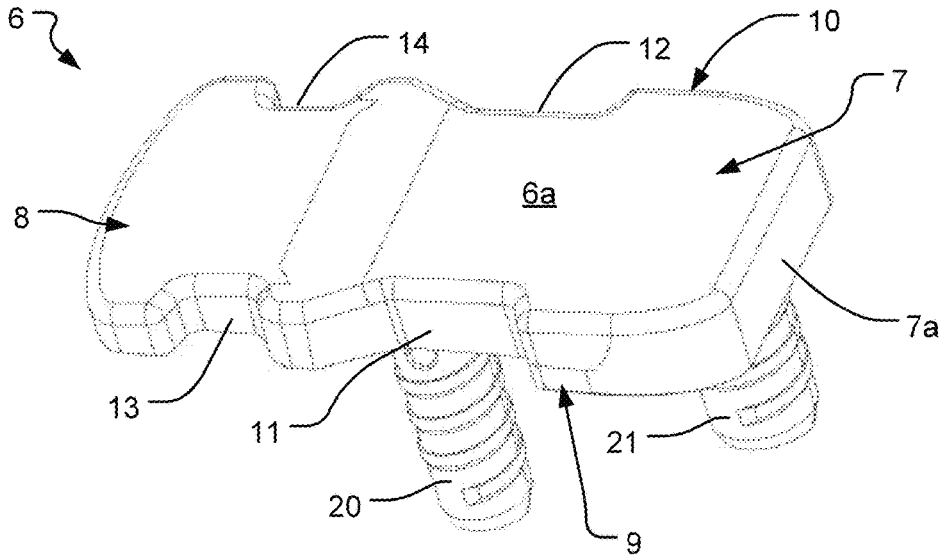
FIG. 1 is a perspective view of a mounting bracket of a screening arrangement in a first embodiment of the invention.
Figure 2:
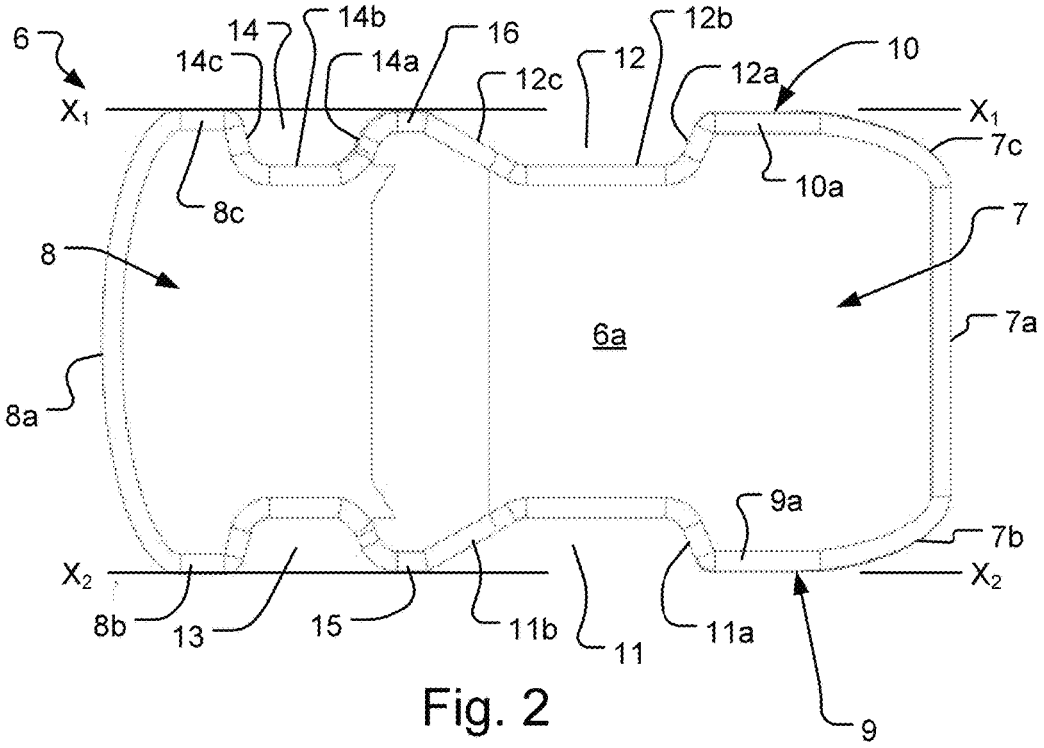
FIG. 2 is a top view of the mounting bracket of FIG. 1.

In the drawing figures, parts of a screening arrangement are shown. The screening arrangement comprises a screening device represented by one of its end pieces, namely end piece 410 shown separately in FIGS. 6 and 7, and a set of mounting brackets, of which three embodiments are shown. The first embodiment of one mounting bracket 6 will be described with reference to FIGS. 1 to 5, and the mounting bracket 6 is shown in cooperation with the end piece 410 in FIGS. 8 and 9.

Figure 15:
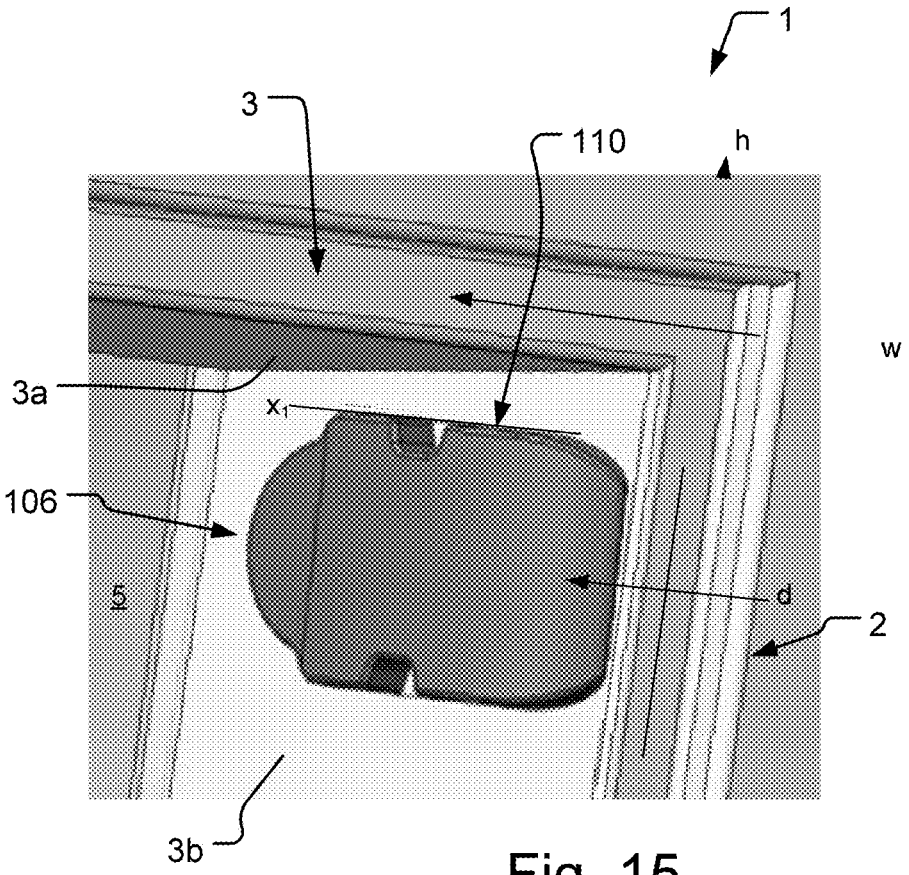
FIG. 15 is a schematic perspective view of a window in an embodiment of the invention, with a mounting bracket as shown in FIGS. 10 to 14.
Figure 16:
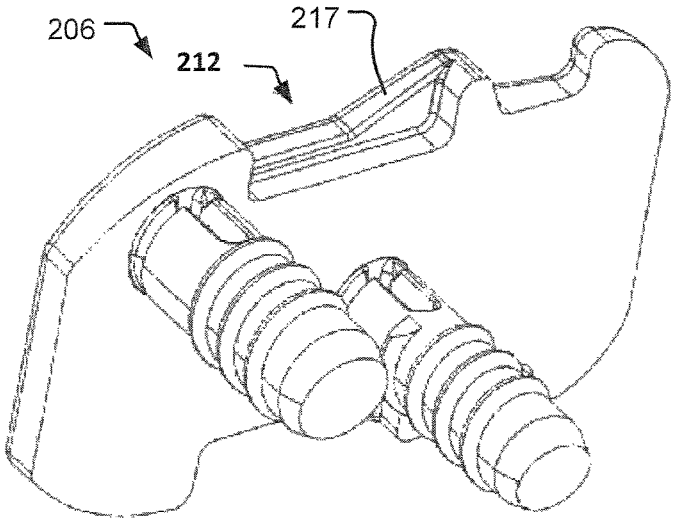
FIG. 16 is a perspective view of a mounting bracket of a screening arrangement in a third embodiment.
Figure 17:
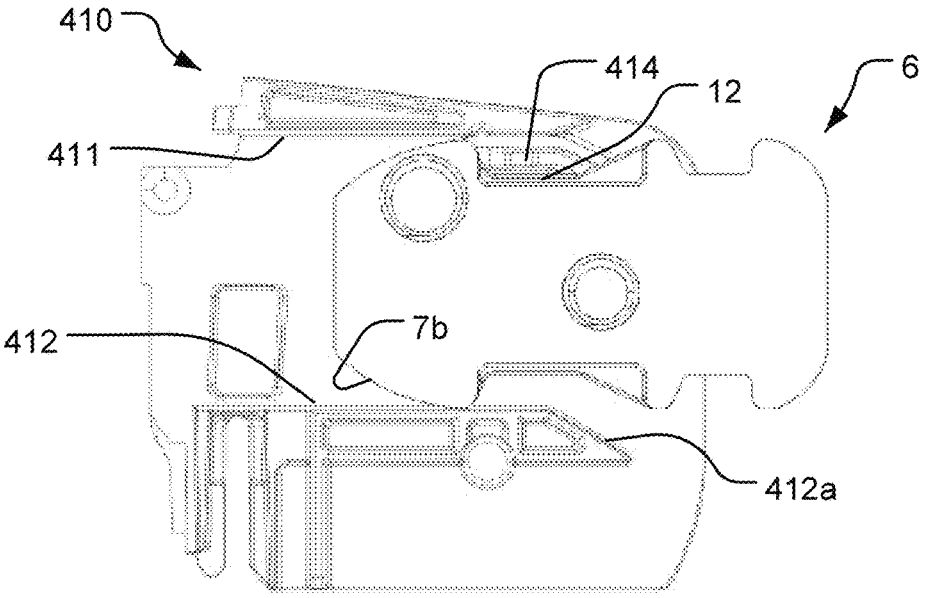
FIGS. 17 and 18 are views corresponding to FIGS. 8 and 9 of the end piece of FIGS. 6 and 7 in engagement with the mounting bracket of the third embodiment.
Figure 18:
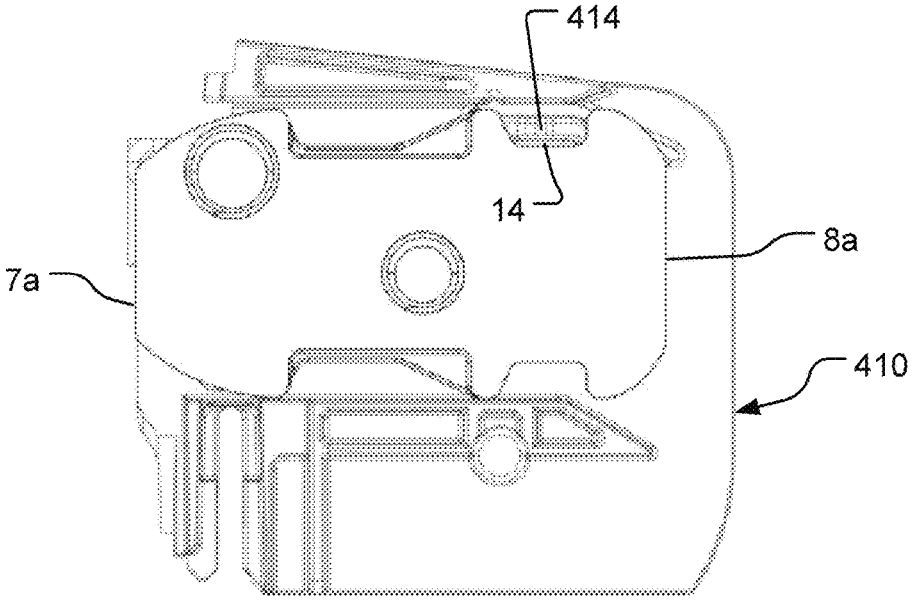
Figure 19:
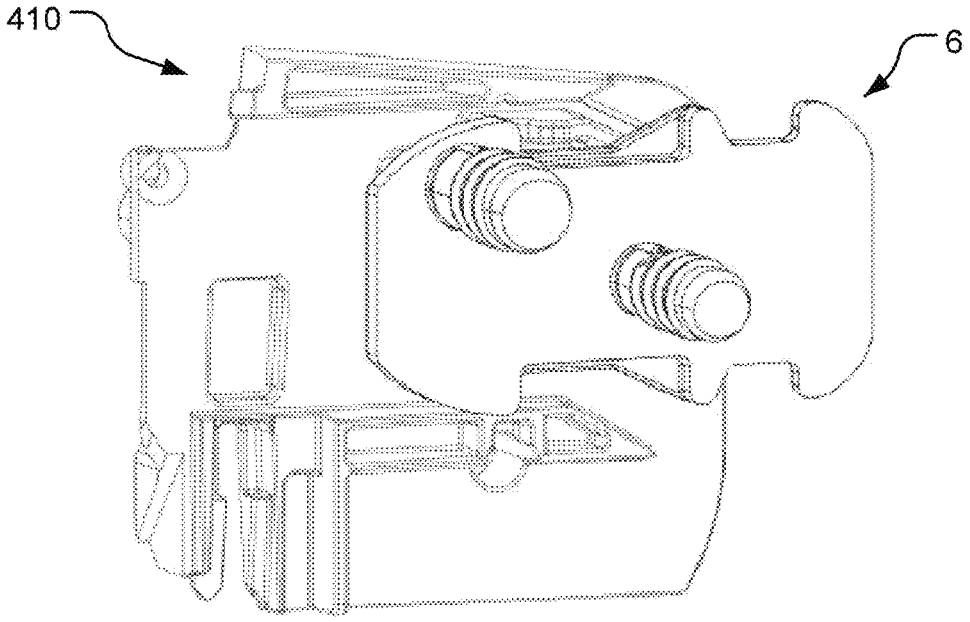
FIGS. 19 and 20 are perspective views corresponding to FIGS. 17 and 18 showing the engagement of the end piece with the mounting bracket.
Figure 20:
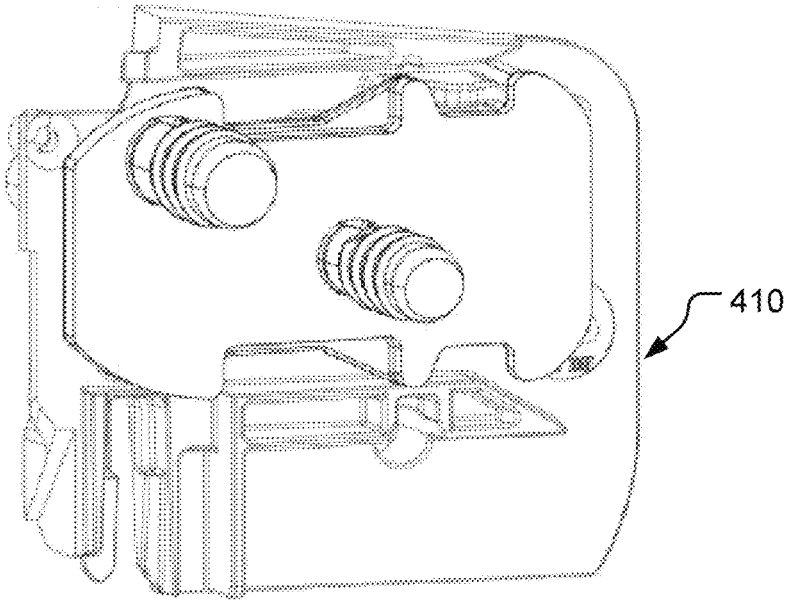

As is known as such, the screening arrangement according to the invention is adapted to be mounted in a window frame of a window 1 as shown in FIG. 15. The window frame may be an openable sash 3 encasing a pane 5 and adapted to be mounted in a stationary frame 2 to be installed in an inclined roof surface. It is noted that the terms "sash" or "frame" are to be understood as incorporating any substantially rectangular structure positioned in any opening in a building, whether in a wall or the roof, and surrounding an aperture to be screened. The window frame need not be composed of separate frame members but may be a coherent frame. Notwithstanding, the portions of the window frame are referred to as "top member" denoted by reference numeral 3*a* in FIG. 15, "side members", of which one side member 3*b* is shown in FIG. 15, and "bottom member" in order to facilitate reading. Thus, the window frame is substantially rectangular and has a top member, two side members and a bottom member.

The screening arrangement is provided in a supply condition and is configured to be installed in the window frame to attain a mounted condition.

Terms such as "left-hand" and "right-hand" refer to the orientation shown in the drawings and/or in the mounted condition, and are utilized for reasons of convenience only. Similarly, the terms "front" and "back" are utilized to denote the sides of the screening arrangement, "front" being the side intended to face inwards into the interior of a building, and "back" the outwards facing side. The terms "upper" and "lower" refer to the orientation of the screening arrangement installed in a frame, where "upper" refers to general direction towards the top member of the frame and "lower" refers to the direction towards the bottom member of the frame.

Furthermore, and referring still to FIG. 15, a first direction is defined as being parallel to a longitudinal direction of the top and bottom members corresponding to a width direction w of the frame. A second direction is defined as being parallel to a longitudinal direction of the side members corresponding to a height direction h of the frame. A third, or transverse, direction is defined as being perpendicular to the first and second directions corresponding to a depth direction d of the frame.

Referring now to FIGS. 1 to 5, a first embodiment of the mounting bracket 6 is shown in detail. The mounting bracket 6 forms part of a set of mounting brackets to be mounted at opposite frame side members. The mounting brackets of a set are typically identical, but variations are conceivable.

The mounting bracket 6 has a thickness dimension, a height dimension, and a length dimension. When connected to the frame of the window, the thickness dimension is parallel to the first direction, the height dimension is parallel to the second direction, and the length dimension is parallel to the third direction.

The mounting bracket 6 comprises a surface 6*a* and is provided with a front portion 7 with a front edge 7*a* and two rounded front corners 7*b*, 7*c*, and a back portion 8 with a back edge 8*a*. At the face opposite surface 6*a*, the bracket member 6 is provided with two legs 20 and 21 to cooperate with openings in the window frame side members.

The mounting bracket 6 is provided as a moulded part of a suitable material such as a plastic material and the dimensions chosen for the length, height and thickness are chosen from the respective ranges of 20 to 45 mm (length); 15 to 25 mm (height); and 2 to 10 mm (thickness).

The mounting bracket 6 has a top ledge 10 extending in the length dimension of the mounting bracket 6, in the third direction in the mounted condition, substantially along an upper line $x_1$.

In the embodiment shown, the mounting bracket is symmetrical around an axis extending in the length dimension, substantially corresponding to the arrow indicating the depth direction d in FIG. 15. Hence, at the side opposite the top ledge 10, the mounting bracket 6 has a bottom edge 9. In the embodiment shown, the bottom edge 9 thus has a certain thickness, corresponding to the thickness of the top ledge 10. Depending on the configuration of the window, it is also possible to have an asymmetrical shape with a bottom edge of very low thickness, the guiding of the end piece on the mounting bracket being assisted by the shape of the frame in which the screening arrangement is mounted.

At the top ledge 10 which defines an upper line $x_1$ of the mounting bracket, the mounting bracket 6 is provided with a set of female locking means in order to provide engagement with the end piece 410 during installation of the screening arrangement. As will be described in detail further on, the end piece 410 is provided with protruding male locking means.

In the embodiment shown, a first female locking means comprises recess 12 and a second female locking means comprises recess 14. The two female locking means 12, 14 are provided substantially below upper line $x_1$ parallel to the length dimension of the mounting bracket 6.

As the mounting bracket 6 of the embodiment shown is symmetrical, corresponding recesses 11 and 13 are provided at the bottom edge 9. These recesses 11, 13 serve as female locking means in such embodiments of the end piece of the screening device comprising male locking means at the lower side of the end piece. This third recess 11 opposite the first recess 12 and fourth recess 13 opposite the second recess 14 are located substantially above a lower line $x_2$ parallel to the length dimension of the mounting bracket 6. As indicated most clearly in FIG. 2, the first recess 12 is provided with a first inclined portion 12*a*, a second bottom portion 12*b* and a third inclined portion 12*c*.

The first inclined portion 12*a* extends relatively steeply from the top ledge 10 to the second bottom portion 12*b*. The depth of the recess 12, i.e. the height from the second bottom portion 12*b* to the top ledge 10 and the upper line $x_1$ is chosen in accordance with the overall dimensions of the mounting bracket 6 and the end pieces of the screening device in order to obtain appropriate engagement. Typically, the depth of the recess 12 is chosen from the approximate range of 4 to 8 mm.

The third inclined portion 12*c* has an inclination with the length dimension of the mounting bracket 6. The inclination should not be too steep, typically 20 to 60 degrees, here approximately 30 degrees.

Also the second recess 14 is provided with a first inclined portion 14*a*, a second bottom portion 14*b* and a third inclined portion 14*c*, the first inclined portion 14*a* here has an inclination in the range of 45 to 80 degrees with the length dimension of the mounting bracket 6. The inclination of the third inclined portion 14*c* is steep, or even substantially perpendicular, to the upper line $x_1$ of the mounting bracket 6 to provide a full stop of the movement of the end piece with the male locking means interacting with the second female locking means, i.e. the second recess 14.

In order to ensure that the user experiences that it is easier to mount the screening device than to remove the screening device from the mounted condition, the third inclined portion 12*c* of the first recess 12 has a smaller inclination than the first inclined portion 14*a* of the second recess 14.

The transition between the first recess 12 and the second recess 14 is constituted by bridge portion 16 positioned substantially at the upper line $x_1$ and hence forms part of the top ledge 10.

At the back of the mounting bracket 10, the transition to the back edge 8*a* from the second recess 14 is provided by back portion 8*c*, located substantially at the upper line $x_1$ and thus forming part of the top ledge 10.

In the embodiment shown, the top ledge 10 of the mounting bracket 6 is composed by a front portion 10*a*, the bridge portion 16 separating the first recess 12 from the second recess 14, and back portion 8*c*, each of these portions being positioned substantially on the upper line $x_1$, preferably in parallel with the third direction d in the mounted condition of the mounting bracket.

At the lower edge 9, similar portions are present as front portion 9*a*, bridge portion 15 and back portion 8*b*.

Figure 4:
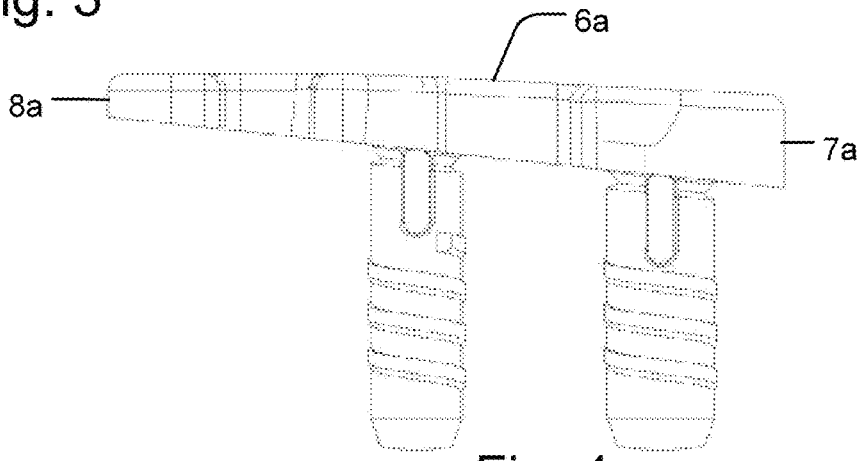
FIG. 4 is a side view of the mounting bracket of FIG. 1.
Figure 5:
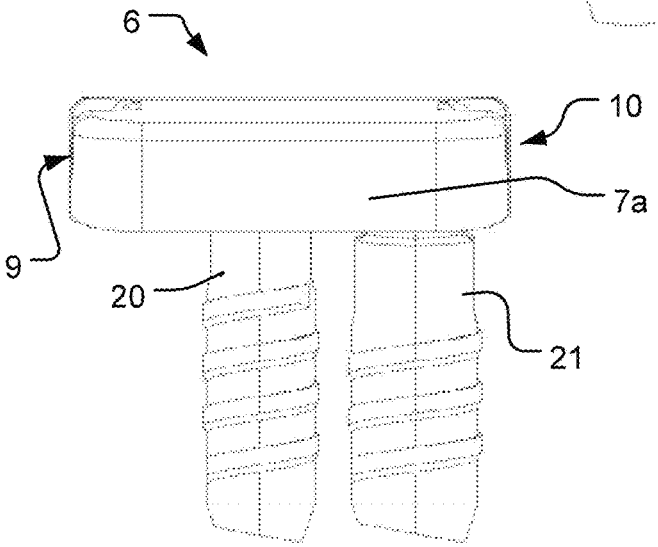
FIG. 5 is a front view of the mounting bracket of FIG. 1.

As shown most clearly in FIG. 4, the mounting bracket 6 of the first embodiment is substantially wedge-shaped, with the thickness of the front edge 7*a* being larger than the back edge 8*a*. According to the above-identified definitions, the thickness dimension of mounting bracket 6 is generally parallel to the first direction: in case of a wedge-shaped mounting bracket, the thickness dimension corresponds to a general direction of the mounting bracket 6. The wedge-shape accommodates the inclination of a beveled window frame.

Figure 6:
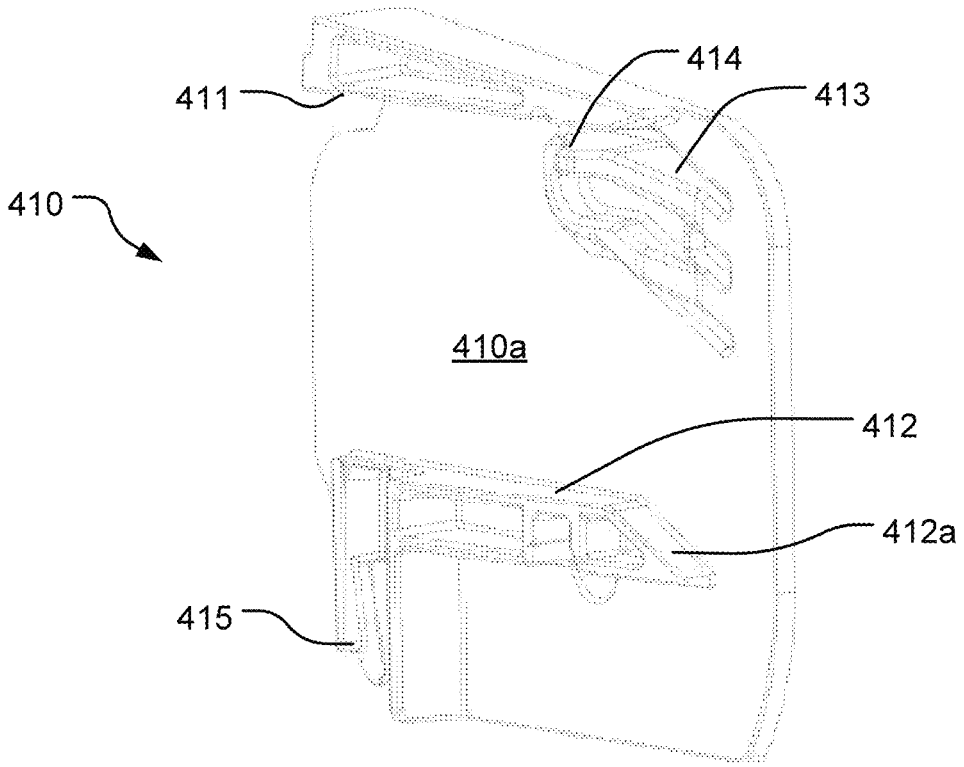
FIG. 6 is a perspective view of an end piece of a screening arrangement in an embodiment of the invention.
Figure 7:
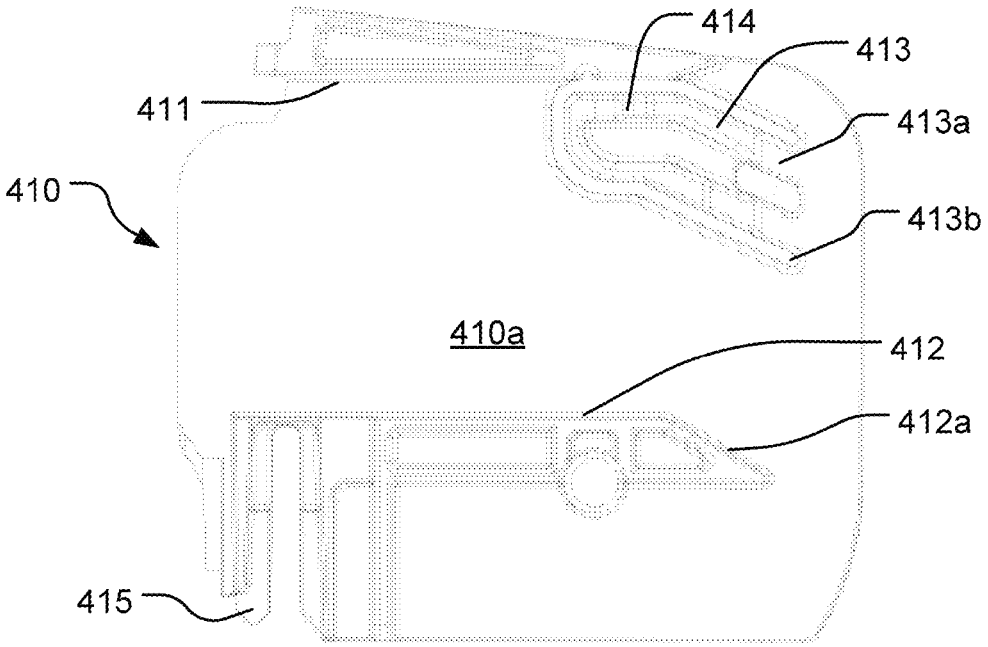
FIG. 7 is a side view of the end piece of FIG. 6.

Referring now to FIGS. 6 and 7, the one end piece 410 of a set of end pieces of the screening device will be described in some detail. The two end pieces of the set are positioned at opposite ends of an elongated top casing of the screening device, which extends in parallel with the first direction in the mounted condition. The opposite end piece has an outer side configured in a substantially mirror-inverted manner relative to the shown end piece 410.

Figure 3:
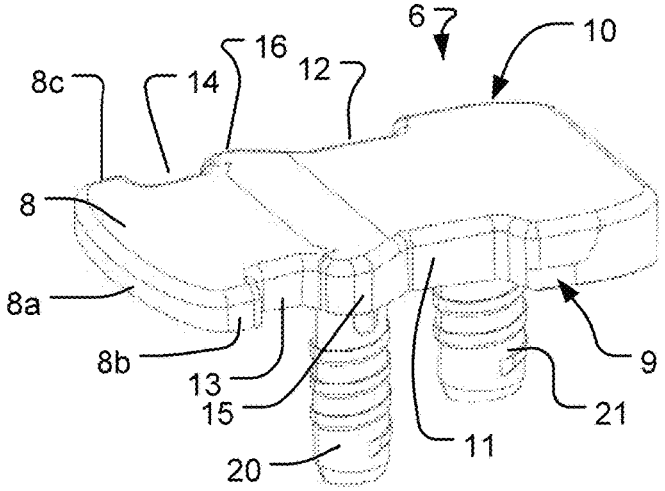
FIG. 3 is a perspective view, from another angle, of the mounting bracket of FIG. 1.

The end piece 410 of FIGS. 6 and 7 is configured substantially as described in Applicant's international publication WO 2008/131757 A1 including in its description of the embodiment of FIG. 3 to which reference is made.

From a generally plane body portion 410*a*, upper guide surface 411 and a lower guide surfaces are formed as top flange 411 and bottom flange 412. At one end, the bottom flange 412 is formed with an inclined portion forming a ramp 412*a*. The ramp 412*a* is formed at the end intended to be positioned at the back when mounted, and is thus the end which is first brought into contact with the bracket member 6. The ramp 412*a* thus serves to facilitate correct positioning of the screening device.

At the top flange 411 resilient engagement means comprising male locking means are provided. The end piece 410 comprises a tongue 413 extending from a point at the back of end piece 410 in the direction towards the front such that one portion, i.e. back portion 413*a*, of the tongue has a direction substantially parallel with that of the ramp 412*a* on the bottom flange 412 and one portion is substantially parallel with the top flange 411 and the bottom flange 412. The tongue 413 is separated from the remaining portion of the end piece 410 by a slit 413*b*. The tongue 413 furthermore includes the male locking means to provide snap engagement means in the form of upstanding retaining pawl 414 on the tongue 413. In the embodiment shown of the mounting bracket 6, the first recess 12 is provided with an over-dimension in the length dimension of the mounting bracket 6 relative to the male locking means in the form of retaining pawl 414.

Furthermore, the end piece 410 has spring means 415 for cooperation with a cord system of a further screening arrangement (not shown).

As will be described in further detail below, when the screening device represented by its one end piece 410 is at its travel in the third direction, male locking means in the form of the retaining pawl 414 snaps out into engagement with the first and second female locking means.

An alternative end piece for cooperation with the mounting bracket is shown in EP2474702 B1. Here, the flexible and elastic locking tab is provided at the lower edge of the end piece.

As is indicated in the above, the mutually cooperating locking means comprise snap locking means. In general, the snap locking means comprise resilient engagement means of the male locking means, in the embodiment shown constituted by tongue 413 and retaining pawl 414, of the respective end piece to provide a spring bias. In the embodiment shown, the spring bias is primarily in first direction w, but bias in the second direction h or the third direction d or combinations of the first, second and/or third directions are clearly conceivable.

Although not described in detail, the person skilled in the art will be able to conceive of embodiments in which the snap locking means are formed such that an indication of the snap locking is provided when the respective end piece is in the second, terminal position.

Figure 8:
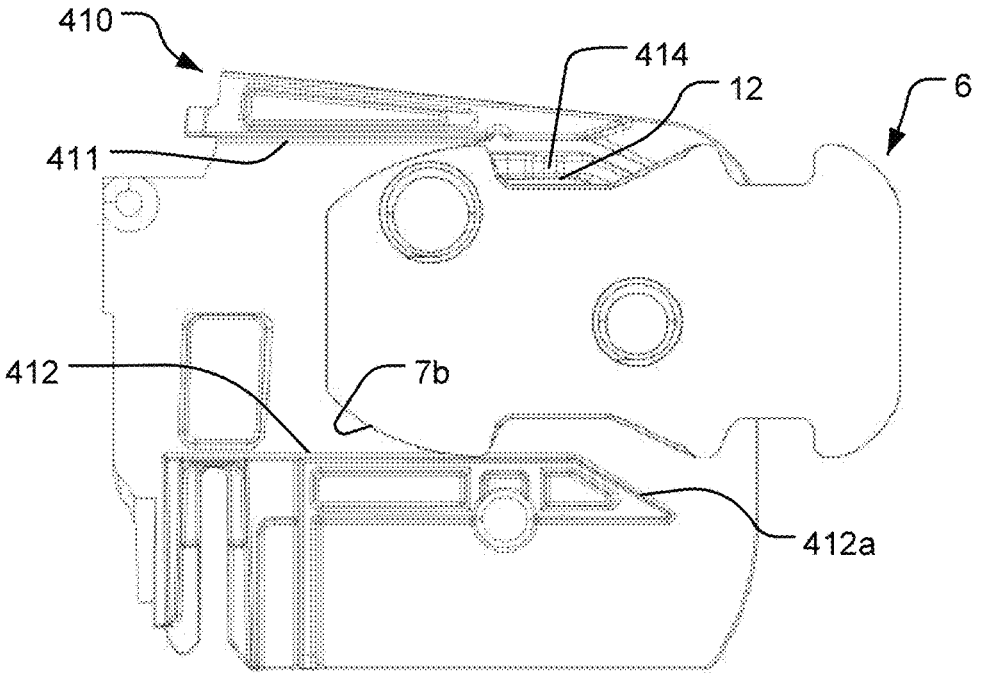
FIG. 8 is a side view of the end piece of FIGS. 6 and 7 in engagement with the mounting bracket of the first embodiment in a first position.
Figure 9:
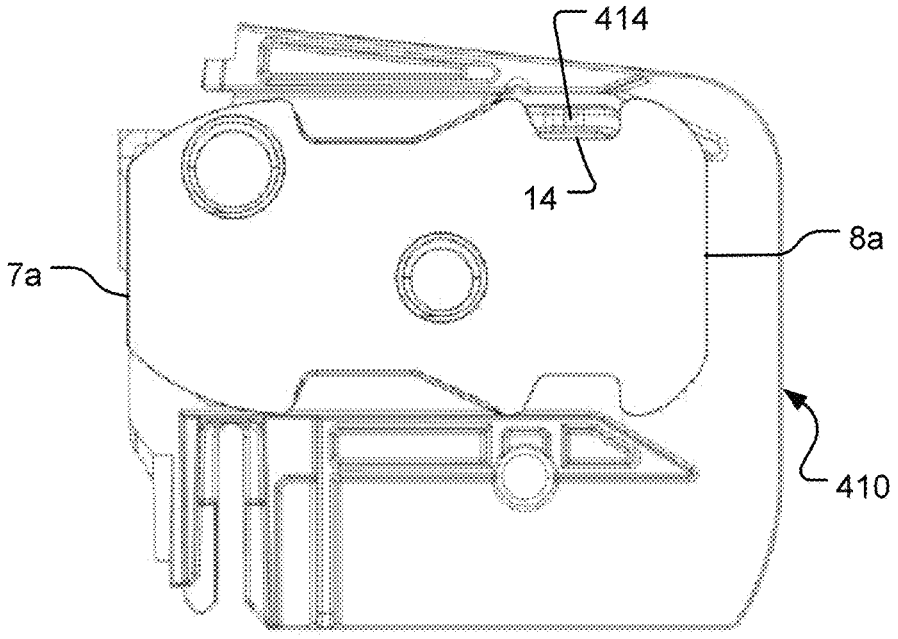
FIG. 9 is a side view corresponding to FIG. 8 in a second position.
Figure 10:
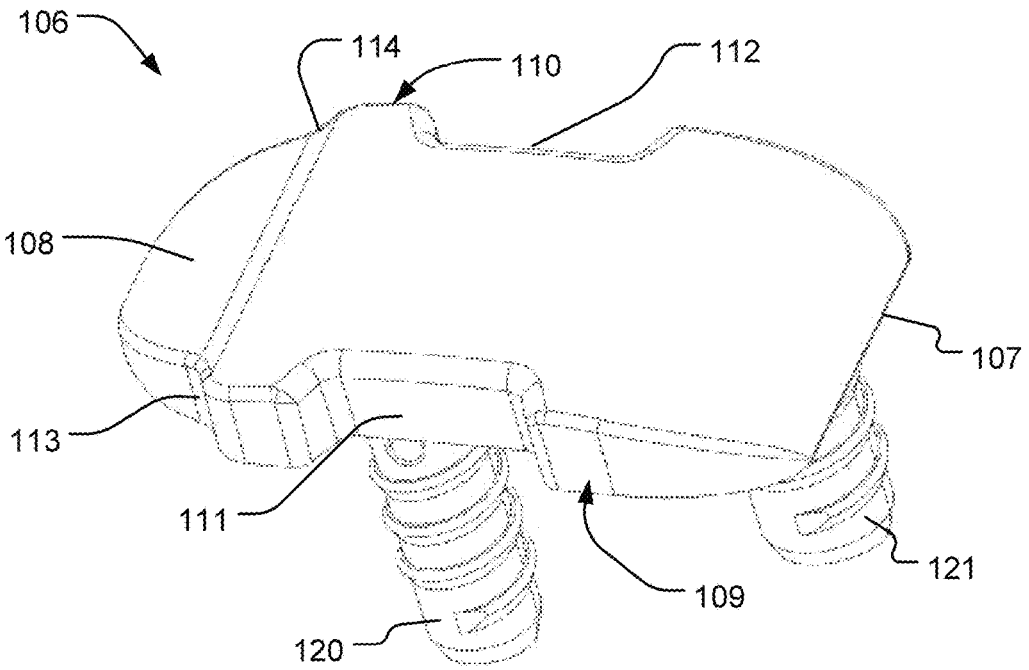
FIGS. 10 to 14 are views corresponding to FIGS. 1 to 5 of a mounting bracket of a screening arrangement in a second embodiment of the invention.
Figure 11:
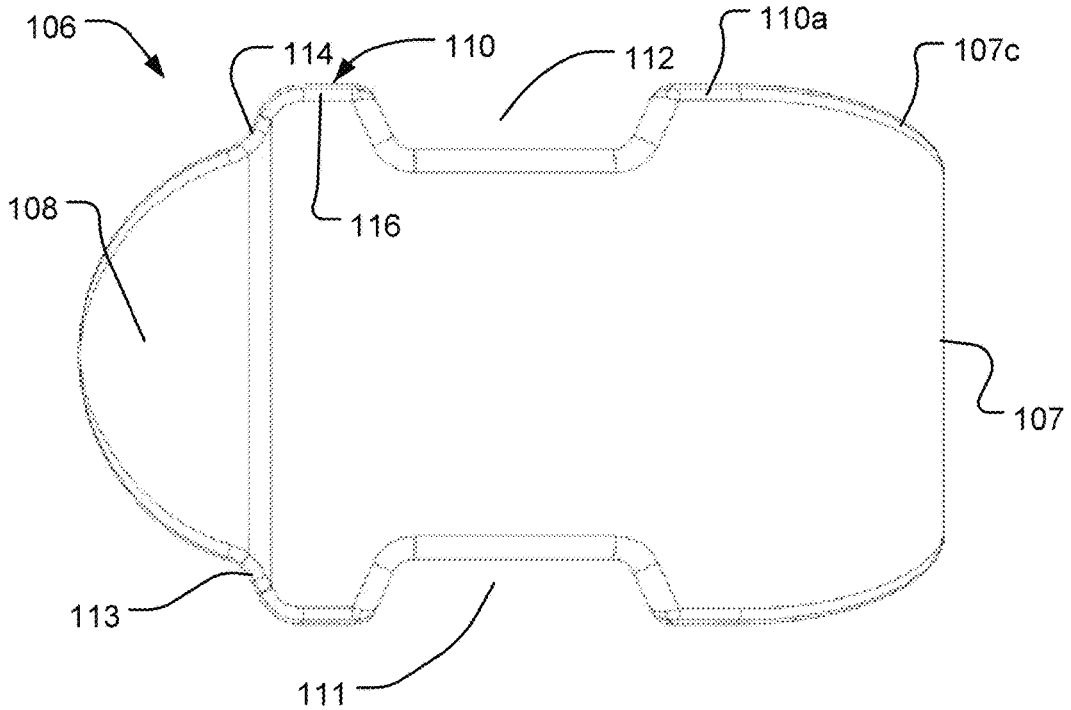
Figure 12:
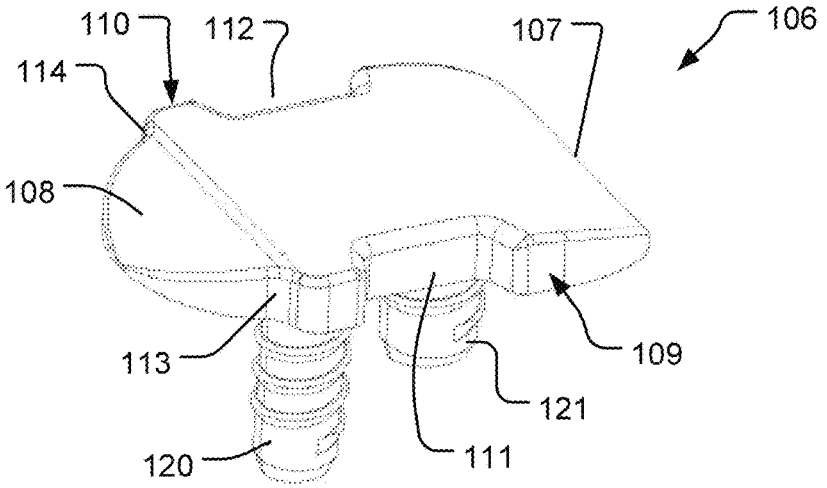
Figure 13:
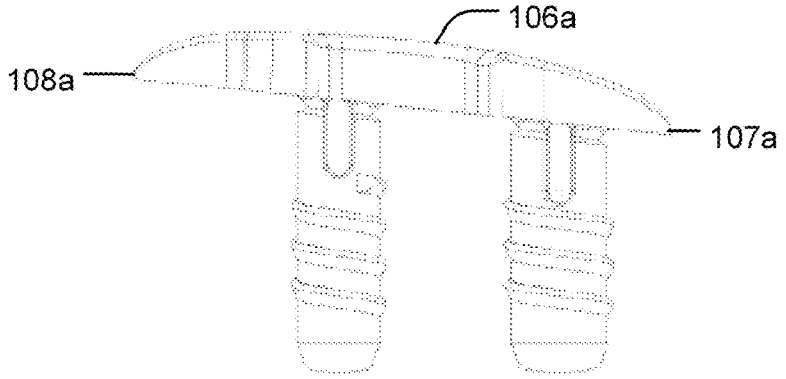
Figure 14:
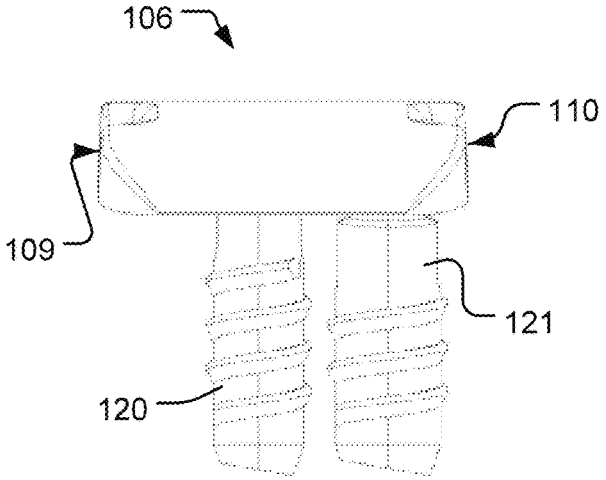

Mounting of the screening device with the end pieces on the mounting brackets will be described in some detail with reference to FIGS. 8 and 9. For the general description of the parts of the window 1, reference is also made to FIG. 15.

Bringing the screening device of the screening arrangement to its mounted condition involves engaging the two end pieces of the screening device with the two mounting brackets mounted on opposing side members of the frame. During mounting, the screening device with its set of end pieces is moved substantially in the third direction d from a point distant from the pane to a point proximate to the pane.

During the installation procedure, the two female locking means 12, 14 are able to cooperate successively with the one male locking means 414, so that it is possible to provide engagement between each end piece and the respective mounting bracket in a first, temporary position, and in a second, terminal position.

In a first step, the top flanges 411 of the end pieces 410 of the screening device are aligned with the top ledges 10 of the respective mounting bracket 6.

Secondly, the top flanges 411 of the end pieces 410 of the screening device are supported on the top ledges 10 of the respective mounting bracket 6.

Third, the screening device is moved in the third direction.

Subsequently, the end pieces are locked to the mounting brackets in a first, temporary position. This is represented by the position shown in FIG. 8, in which the male locking means in the form of retaining pawl 414 is engaged in the first recess 12.

From this position, the screening device is moved further in the third direction.

Finally, the end pieces are locked to the mounting brackets in a second, terminal position to attain the mounted condition. This is shown in FIG. 9, in which the male locking means in the form of retaining pawl 414 interacts with the second recess 14.

In the second embodiment of the mounting bracket 106 shown in FIGS. 10 to 15, only details different from the first embodiment will be described. Parts having the same or analogous function will be denoted by the same reference numerals to which 100 has been added.

In this embodiment, the at least two female locking means of the mounting bracket 106 comprise a recess 112 as in the first embodiment and a shoulder portion 114 to provide the second, terminal position.

As in the first embodiment, the female locking means comprise an opposing recess 111 opposite the first recess 112 and an opposing shoulder portion 113 opposite the shoulder portion 114.

Referring now to FIG. 15 in particular, a further feature of an embodiment of the window according to the invention appears.

The window 1, which may be a roof window, with its frame 3 encasing pane 5 comprises a set of two mounting brackets, in the embodiment shown mounting brackets 106, mounted to the respective side member 3*b* near an intersection with the top member 3*a*. The distance from the top ledge 110 of the mounting bracket 106 to the intersection with the top member 3*a* is typically chosen such that when the screening device is mounted on the mounting brackets in the window frame, the top casing of the screening device abuts the top member 3*a*.

Specifically in the embodiment of the window 1 shown in FIG. 15, the side members 3*b* have such dimensions that the height of each side member at the point distant from the pane 5, i.e. facing the room, is larger than the height of the side member at the point proximate to the pane 5 such that the upper line $x_1$ of the mounting bracket forms an angle with the intersection between the top member 3*a* and the respective side member 3*b*. The angle is typically small, in the range of 5 to 15 degrees. Thus, a wedge-shaped space is present between the top ledge 110 of the mounting bracket 106 and the downwards facing side of the frame top member 3*a* at the intersection with the side member 3*b*. The wedge-shape entails that the configuration of the window itself may contribute to the keeping in place of the screening device in the window frame.

In the third embodiment shown in FIGS. 16 to 20, the mounting bracket 206 has a configuration substantially corresponding to that of the first embodiment. In this embodiment the first recess 212 is provided with a flange 217 having a reduced thickness relative to the thickness of the mounting bracket 206 in the area of the first recess 212. The flange makes it possible to utilise the mounting bracket 206 as support for accessories such as other screening devices than those including end pieces.

The invention should not be regarded as being limited to the described embodiments. Several modifications and combinations of the different embodiments will be apparent to the person skilled in the art.

The invention claimed is:

1. A screening arrangement for a window having a frame encasing a pane, the frame including a top member, two side members and a bottom member and, the frame defining a first direction parallel to a longitudinal direction of the top and bottom members, the first direction corresponding to a width direction of the frame, a second direction parallel to a longitudinal direction of the side members, the second direction corresponding to a height direction of the frame, and a third direction perpendicular to the first and second directions, the third direction corresponding to a depth direction of the frame, comprising:

a screening device including two end pieces configured to extend in parallel with said first direction when the screening device is in a mounted condition, each end piece having a top flange, and two mounting brackets, each mounting bracket having a thickness dimension, a height dimension, and a length dimension, and being adapted to be mounted to a respective side member of the frame, such that the thickness dimension is parallel to the first direction, the height dimension is parallel to the second direction, and the length dimension is parallel to the third direction, each mounting bracket having a top ledge defining an upper line of the mounting bracket and extending in the length dimension of the mounting bracket, in the third direction in the mounted condition of the mounting bracket, in which the screening device during mounting is configured to be connected with the mounting brackets by moving the screening device substantially in the third direction from a point distant from the pane to a point proximate to the pane, the top flange of the end pieces of the screening device being configured to ride on top of the top ledge of the respective mounting bracket during mounting and to be supported on the top ledge of the respective mounting bracket in the mounted condition of the screening device, and locking means for providing engagement between the end pieces and the respective mounting brackets, said locking means including mutually cooperating female and male locking means, said female locking means and said male locking means being provided in one of the following orientations: (i) said female locking means being provided on each of the end pieces and said male locking means being provided on each of the mounting brackets, and, (ii) the male locking means being provided on each of the end pieces and the female locking means being provided on each of the mounting brackets, said female locking means including at least two female locking portions to cooperate successively with one male locking means to provide engagement between each end piece and the respective mounting bracket in at least two positions including a first, temporary position and a second, terminal position on the mounting bracket, when the end pieces are moved with the screening device in the third direction from the point distant from the pane to the point proximate to the pane.

2. The screening arrangement according to claim 1, wherein at least one mounting bracket is provided with a front portion with a front edge and two rounded front corners, and a back portion with a back edge.

3. The screening arrangement according to claim 1, wherein the mutually cooperating locking means comprise snap locking means.

4. The screening arrangement according to claim 3, wherein the snap locking means comprise resilient engagement means of the male locking means of the respective end piece to provide a spring bias in the first direction, the second direction or the third direction or a combination of at least two of the first, second and third directions.

5. The screening arrangement according to claim 3, wherein the snap locking means are formed such that an indication of the snap locking is provided when the respective end piece is in the second, terminal position.

6. The screening arrangement according to claim 1, wherein the at least two female locking portions are provided substantially below the upper line defined by the top ledge parallel to the length dimension of the mounting bracket, in the third direction in the mounted condition of the mounting bracket.

7. The screening arrangement according to claim 6, wherein the at least two female locking portions comprise a first recess in the top ledge of the mounting bracket closer to the point distant from the pane as seen in the third direction in the mounted condition of the mounting bracket to provide the first, temporary position.

8. The screening arrangement according to claim 7, wherein the first recess is provided with an over-dimension in the length dimension of the mounting bracket relative to corresponding dimension of the male locking means.

9. The screening arrangement according to claim 7, wherein the first recess is provided with a flange in the area of the first recess, substantially extending in parallel with a plane defined by the length and height dimension of the mounting bracket, said flange having a reduced thickness relative to the thickness of the mounting bracket.

10. The screening arrangement according to claim 7, wherein the at least two female locking portions comprise a shoulder portion closer to the point proximate to the pane as seen in the third direction in the mounted condition of the mounting bracket to provide the second, terminal position.

11. The screening arrangement according to claim 10, wherein the at least two female locking portions comprise an opposing recess opposite the first recess and an opposing shoulder portion opposite the shoulder portion substantially above a lower line parallel to the length dimension of the mounting bracket.

12. The screening arrangement according to claim 11, wherein the first recess is separated from the shoulder portion by a bridge portion positioned on the upper line, the bridge portion being substantially parallel to the third direction in the mounted condition of the mounting bracket.

13. The screening arrangement according to claim 12, wherein the top ledge is composed by a front portion and the bridge portion, each of these portions being positioned substantially on the upper line, in parallel with the third direction in the mounted condition of the mounting bracket.

14. The screening arrangement according to claim 7, wherein the first recess is provided with a first portion, a second portion and a third portion, wherein the second portion is a bottom portion and each of the first portion and the third portion is an inclined portion.

15. The screening arrangement according to claim 14, wherein, the third inclined portion has an inclination of 20 to 60 degrees with the length dimension of the mounting bracket.

16. The screening arrangement according to claim 14, wherein the at least two female locking portions further comprise a second recess in the top ledge of the mounting bracket closer to the point proximate to the pane as seen in the third direction in the mounted condition of the mounting brackets to provide the second, terminal position.

17. The screening arrangement according to claim 16, wherein the top ledge of the mounting bracket is composed by a front portion, a bridge portion separating the first recess from the second recess, and a back portion, each of these portions being positioned substantially on the upper line, in parallel with the third direction in the mounted condition of the mounting bracket.

18. The screening arrangement according to claim 16, wherein at least two female locking portions comprise a third recess opposite the first recess and a fourth recess opposite the second recess substantially above a lower line parallel to the length dimension of the mounting bracket.

19. The screening arrangement according to claim 16, wherein the second recess is provided with a first portion, a second portion and a third portion, wherein the second portion is a bottom portion and each of the first portion and the third portion is an inclined portion.

20. The screening arrangement according to claim 19, wherein the first inclined portion of the second recess has an inclination of 45 to 80 degrees with the length dimension of the mounting bracket.

21. The screening arrangement according to claim 19, wherein the third inclined portion of the first recess has a smaller inclination than the first inclined portion of the second recess.

22. The screening arrangement according to claim 8, wherein the third inclined portion of the second recess is substantially perpendicular to the upper line of the mounting bracket.

23. A window having a frame encasing a pane, the frame including a top member, two side members and a bottom member and, the frame defining a first direction parallel to a longitudinal direction of the top and bottom members, the first direction corresponding to a width direction of the frame, a second direction parallel to a longitudinal direction of the side members, the second direction corresponding to a height direction of the frame, and a third direction perpendicular to the first and second directions, the third direction corresponding to a depth direction of the frame, said window comprising two mounting brackets, each mounting bracket having a thickness dimension, a height dimension, and a length dimension, and each mounting bracket being connected to a respective side member of the frame such that the thickness dimension is parallel to the first direction, the height dimension is parallel to the second direction, and the length dimension is parallel to the third direction, each mounting bracket having a top ledge defining an upper line of the mounting bracket and extending in the length dimension of the mounting bracket, the upper line extending in the third direction and wherein a screening device during mounting is configured to be connected with the mounting brackets by moving the screening device substantially in the third direction from a point distant from the pane to a point proximate to the pane, the screening device having two end pieces, each end piece having an upper flange being configured to ride on top of the top ledge during mounting and to be supported on the top ledge of the respective mounting bracket when the screening device is mounted in an operating position, and locking means for providing engagement between the end pieces of the screening device and the respective mounting brackets, said locking means including at least two female locking portions and one male locking portion, the at least two female locking portions being configured to cooperate successively with the one male locking portion to provide engagement between an end piece and the respective mounting bracket in at least two different positions including a first, temporary position and a second, terminal position on the mounting bracket during mounting of the screening device.

24. The window according to claim 23, wherein the side members have such dimensions that the height of each side member at the point distant from the pane is larger than the height of the side member at the point proximate to the pane such that the upper line of the mounting bracket forms an angle with the intersection between the top member and the respective side member.

25. A method of installing a screening arrangement in a window, the window having a frame encasing a pane, the frame including a top member, two side members and a bottom member and, the frame defining a first direction parallel to a longitudinal direction of the top and bottom members, the first direction corresponding to a width direction of the frame, a second direction parallel to a longitudinal direction of the side members, the second direction corresponding to a height direction of the frame, and a third direction perpendicular to the first and second directions, the third direction corresponding to a depth direction of the frame, the window further including two mounting brackets, each mounting bracket having a thickness dimension, a height dimension, and a length dimension, and being adapted to be mounted to a respective side member of the frame, such that the thickness dimension is parallel to the first direction, the height dimension is parallel to the second direction, and the length dimension is parallel to the third direction, each mounting bracket having a top ledge defining an upper line of the mounting bracket and extending in the length dimension of the mounting bracket, in the third direction in the mounted condition of the mounting bracket and the screening arrangement including a screening member and two end pieces, each end piece having a top flange, comprising the steps of:

aligning the top flanges of the end pieces of the screening device with the top ledges of the respective mounting bracket, supporting the top flanges of the end pieces of the screening device on the top ledges of the respective mounting bracket, moving the screening device in the third direction such that the top flanges of the end pieces of the screening device ride on top of the top ledges of the respective mounting bracket, locking the end pieces to the mounting brackets in a first, temporary position, moving the screening device further in the third direction, and locking the end pieces to the mounting brackets in a second, terminal position to attain a mounted condition.

* * * * *